US009516985B2

(12) United States Patent
Chignoli et al.

(10) Patent No.: US 9,516,985 B2
(45) Date of Patent: Dec. 13, 2016

(54) FLOOR WASHING-DRYING MACHINE WITH A SCRAPING DEVICE

(71) Applicant: NILFISK A/S, Brøndby (DK)

(72) Inventors: Andrea Chignoli, San Rocco al Porto (IT); Andrea Odoli, Corteolona (IT)

(73) Assignee: NILFISK A/S, Brøndby (DK)

( * ) Notice: Subject to any disclaimer, the term of this patent is extended or adjusted under 35 U.S.C. 154(b) by 0 days.

(21) Appl. No.: 14/761,159

(22) PCT Filed: Dec. 12, 2013

(86) PCT No.: PCT/IB2013/060865
§ 371 (c)(1),
(2) Date: Jul. 15, 2015

(87) PCT Pub. No.: WO2014/125347
PCT Pub. Date: Aug. 21, 2014

(65) Prior Publication Data

US 2015/0359398 A1 Dec. 17, 2015

(30) Foreign Application Priority Data

Feb. 15, 2013 (IT) ..... PN2013A0011

(51) Int. Cl.
*A47L 11/30* (2006.01)
*A47L 11/40* (2006.01)

(52) U.S. Cl.
CPC ..... *A47L 11/4044* (2013.01); *A47L 11/30* (2013.01); *A47L 11/305* (2013.01)

(58) Field of Classification Search
CPC ..... A47L 11/30; A47L 11/305; A47L 11/4044
USPC ..... 15/320, 322, 401
IPC ..... A47L 11/30
See application file for complete search history.

(56) References Cited

U.S. PATENT DOCUMENTS

| | | | | |
|---|---|---|---|---|
| 2008/0104792 | A1 | 5/2008 | Coccapani et al. | |
| 2011/0107552 | A1 | 5/2011 | Shinler et al. | |
| 2011/0314632 | A1 | 12/2011 | Wood | |
| 2015/0342436 | A1* | 12/2015 | Ruiz-Porath ..... | A47L 11/4044 15/300.1 |

FOREIGN PATENT DOCUMENTS

| | | | |
|---|---|---|---|
| EP | 1917898 | A1 | 5/2008 |
| WO | 2010/107432 | A1 | 9/2010 |
| WO | 2011/057228 | A1 | 5/2011 |

OTHER PUBLICATIONS

International Search Report and Written Opinion issued Feb. 27, 2014 in PCT/IB2013/060865 filed Dec. 12, 2013.

* cited by examiner

*Primary Examiner* — David Redding
(74) *Attorney, Agent, or Firm* — Oblon, McClelland, Maier & Neustadt, L.L.P.

(57) ABSTRACT

A washing-drying machine including a scraping device including a reversible fastening system of scraping blades. The reversible fastening system makes it possible to apply the scraping blades to the scraping device in a simple and safe way and as simply to remove them to clean them or replace them when worn out through a flexible fastening mechanism including holes for engaging with support elements provided on the scraping device, and including at least an elastic end portion with a slot for engaging with the undercut of a corresponding locking element, formed in the proximity of end portions of the support.

10 Claims, 6 Drawing Sheets

FLOOR WASHING-DRYING MACHINE WITH A SCRAPING DEVICE

TECHNICAL FIELD OF THE INVENTION

The present invention relates to a floor washing-drying machine comprising a scraping device provided with a reversible blade fastening system. In particular, the invention relates to a reversible fastening system of scraping blades which makes it possible to apply the scraping blades to the scraping device in a simple and safe way and as simply to remove them in order to clean them or replace them when worn out.

PRIOR ART TECHNIQUE

Conventionally, floor washing-drying machines fundamentally comprise two different operating units: a head provided with brushes and with feeding of washing liquid for washing and a scraping device connected to a suction system for the collecting of dirty water and for the floor drying.

In particular, the scraping device is a device which scrapes the floor following the machine, collecting the washing liquid by means of at least a blade mounted on a suitable support provided with a hole or suction passage. The blade is a strip of natural or synthetic rubber material which is pressed against the floor surface so as to scrape it in order to obtain the cleaning effect.

Preferably, the blades are two, curved and parallel, spaced so as to form a suction chamber. In particular, a front blade and a rear blade are mounted onto the support, with respect to the cleaning direction, in order to delimit, together with the floor, said suction chamber. In fact, generally, the front blade is rubbery but more rigid and thinner than the rear blade and it has the function of collecting and conveying the washing liquid into the suction chamber. On the contrary, the rear blade is rubbery but thicker and softer as it has to perform the real drying function.

The front and the rear blades are mechanically fastened to the support so as to be stuck to it in order to prevent air losses from the suction chamber. This fastening has to make it possible an adequate compression of the blades onto the floor and keep them in this position in order to ensure the scraping contact with the floor thereto.

Due to the continuous scraping on the floor, the blades get dirty and are subjected to wearing out. Therefore they must often be removed to be cleaned or replaced.

The floor washing machines currently on the market have different ways of fastening the blades usually made with rigid locking means, with shapes complementary to that of the support, mounted by means of screw-like mobile hooked devices. But these systems are complex to assemble and disassemble and require a long time to remove and place the blades. Moreover, the locking means are sometimes difficult to handle, and gloves and tools must be used.

SUMMARY OF THE INVENTION

The technical problem at the basis of the present invention is therefore that of devising a system for hooking and locking the blades to the corresponding support mounted on a scraping device of a floor washing-drying machine, capable of avoiding complex and difficult operations by the user for the normal usage of the same blades.

Such problem is solved by means of a fastening system of the blades to the support provided with simple but efficient hooking/unhooking elements capable of making maintenance simple and quick by the user of the floor washing-drying machine.

BRIEF DESCRIPTION OF FIGURES

Further characteristics and advantages of the floor washing-drying machine comprising a scraping device provided with a reversible hooking system for the blades according to the invention will become more apparent from the following description of two not limiting forms of embodiment for exemplification only, with reference to the following figures, wherein.

DETAILED DESCRIPTION OF THE INVENTION

Figure 1:
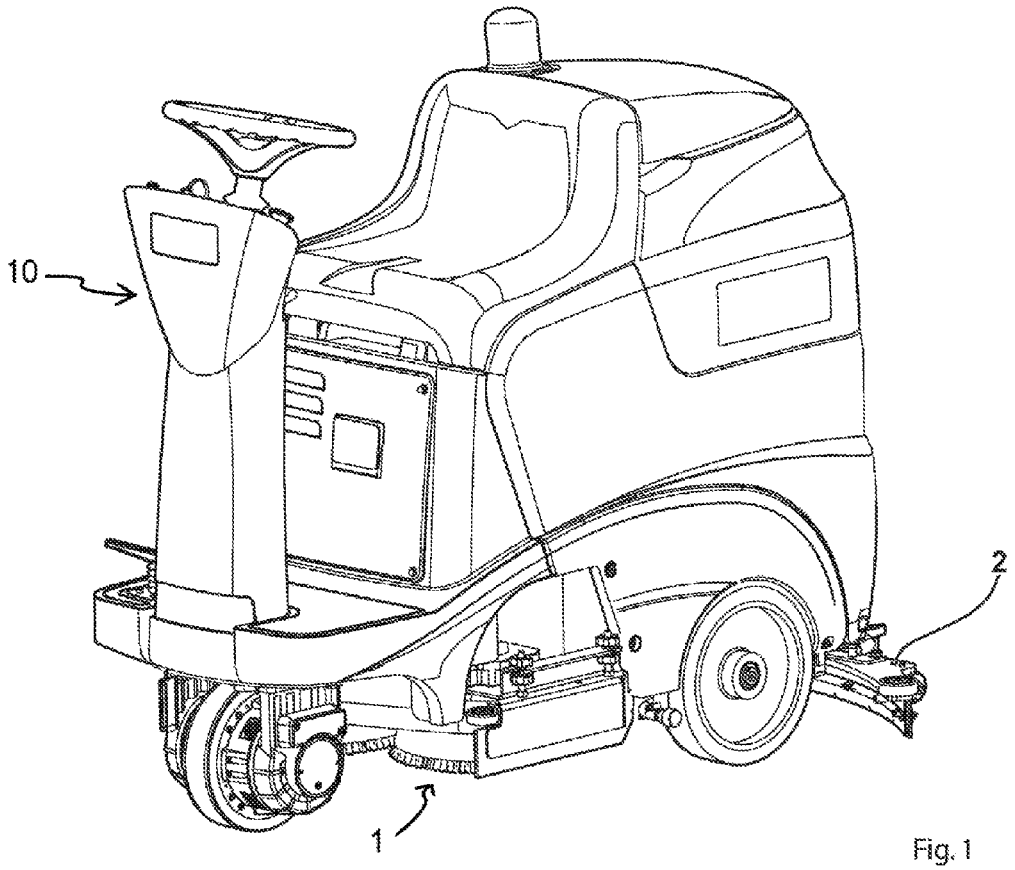
FIG. 1 shows an axonometric view of a floor washing-drying machine.

In FIG. 1 with the reference number 10 it is shown an example of floor washing-drying machine. The floor washing-drying machines 10 are provided with a washing group 1 in the front and a scraping device 2 in the rear with respect to cleaning direction. The scraping device 2 is apt to cleanse, that is to collect and suck in, the washing water used by the washing group for the floor cleaning.

Figure 2:
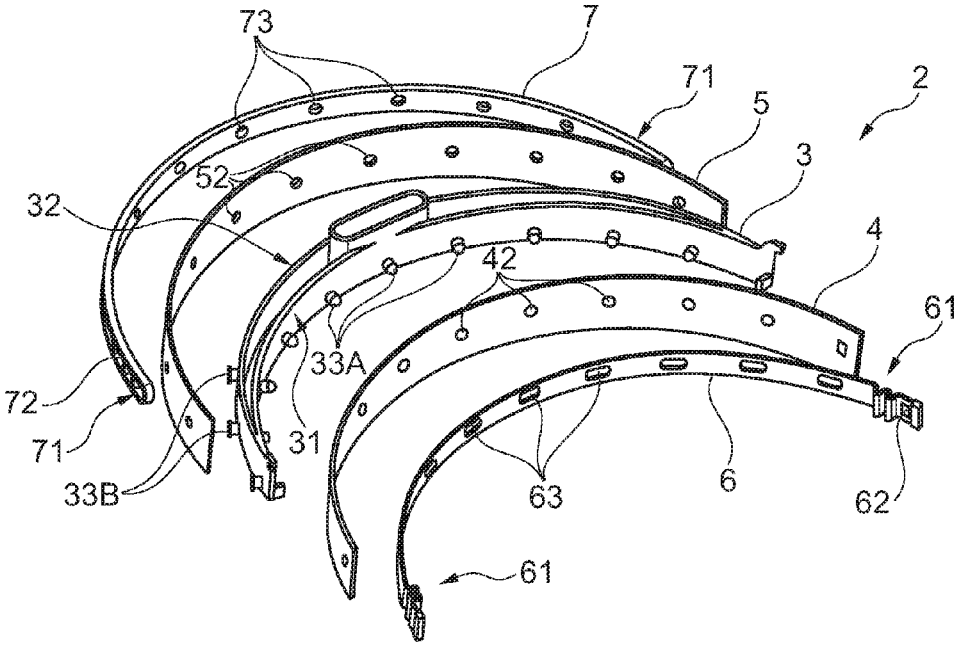
FIG. 2 shows an axonometric and exploded view of a scraping device for the blades of a floor washing-drying machine according to the invention.

The scraping device 2, better shown in the exploded FIG. 2, conventionally comprises a support 3 whereon at least a scraping blade 4, 5 is mounted. Moreover, the support 3 delimits, by means of said at least one blade and the floor, a space or suction chamber (not shown) for the dirty washing water. In particular, the support 3 generally has a curved shape with a first concave surface 31 in the cleaning direction, that is at the front of the machine, and a second convex surface 32 in the direction opposite to that of the cleaning direction, that is at the rear of the machine. Both first 31 and second 32 surfaces are provided with support elements 33A and 33B, respectively, completely projecting and aligned along the longitudinal extension of support 3 with a preset pitch. Preferably, these elements, on one or both first 31 and second 32 surfaces, have a mushroom shape so as to form an engaging undercut with the edges of the holes of the respective blades 4 and 5, as it will be later explained.

Figure 3:
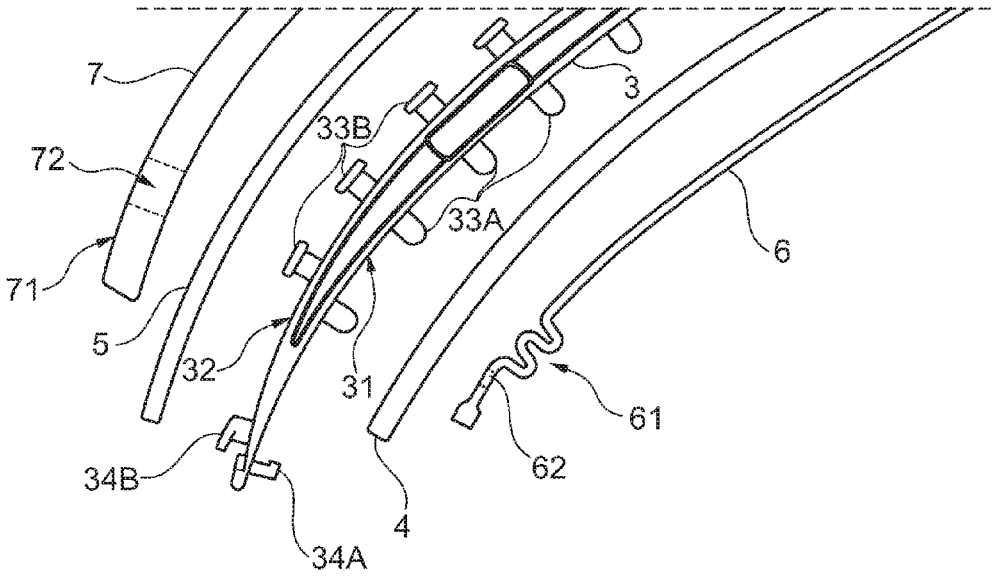
FIG. 3 shows the view of an end portion particular of the scraping device of FIG. 2.
Figure 4:
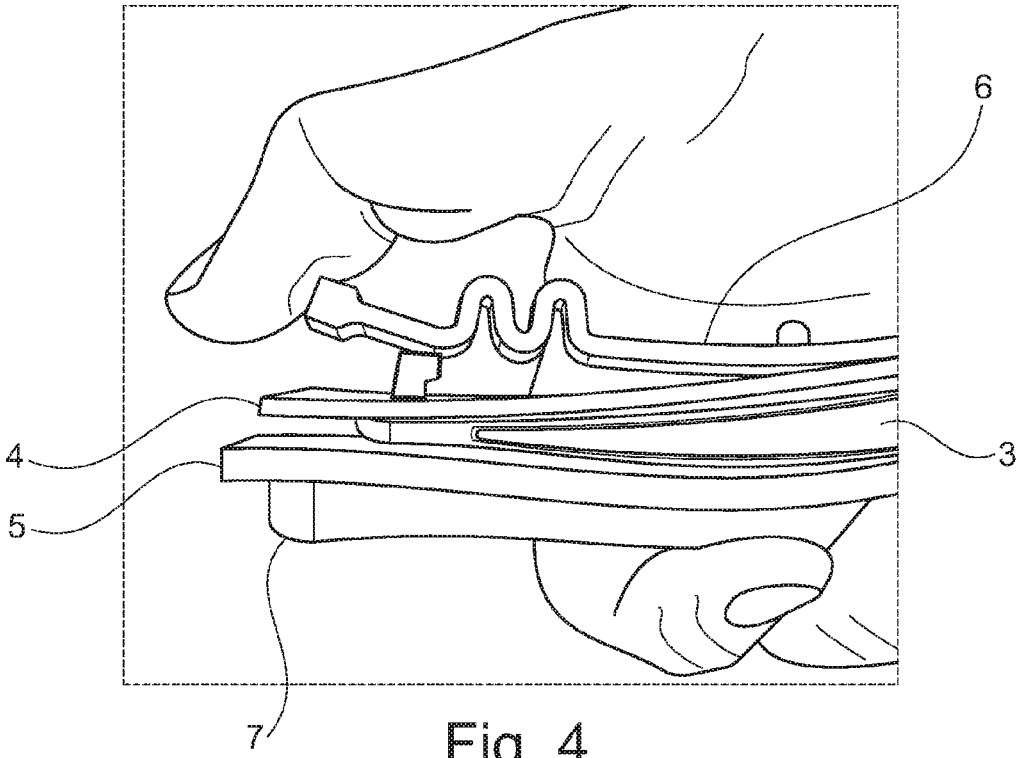
FIG. 4 shows an axonometric view of a particular of a first assembling stage of a blade according to a first embodiment.

Advantageously, as it will be better shown in FIG. 3, in correspondence with the end portions of the support 3 and on both first 31 and second 32 surfaces thereof a preferably hook-shaped fastening element 34A and 34B, respectively, projects. In particular, the fastening element 34A projecting from the first surface 31 of the support 3 is generally L-shaped with a segment facing the longitudinal end of the support. On the contrary, the fastening element 34B projecting from the second surface 32 of the support 3 is generally L-shaped too but with a segment facing the opposite end with respect to where it is situated.

As previously mentioned, at least one scraping blade, preferably two, can be mounted on the support 3. Said at least one blade can be a first blade 4 mounted on said first surface 31 of the support 3, that is on the concave surface, and/or a second blade 5 mounted on the second surface 32 of the support 3, that is on the convex surface.

The first blade 4 is a longitudinal strip generally of rubbery material and provided with notches 41 to allow the passage of the liquid into the suction chamber. This blade therefore has the function of collecting the dirty washing liquid. Moreover, it is crossed by a plurality of holes 42 for engaging with the support elements 33A formed on the first surface 31 of the support 3, as it will be explained later.

Similarly, the second blade is a longitudinal strip, notoriously, with the function of scraping the floor, that is drying, of rubbery material. Therefore, it has a basically uninterrupted contact edge with the floor and it is crossed by a plurality of holes 51 for engaging with the corresponding support elements 33B.

The scraping device 2 according to the present invention comprises, moreover, fastening or locking means apt to cooperate with said support elements 33A and 33B in order to keep the blades 4 and 5 pressed against the support 3 of the scraping device. Advantageously, said means comprise (FIG. 2) at least a flexible belt, perforated and provided with at least an elastic end portion 61, 71 with a slot 62, 72 for engaging with the above said fastening element or hook 34A and 34B placed at the end portion of support 3.

In particular, the flexible belt 6, according to a first embodiment of the invention, is constituted by a strip of hard plastic but flexible material whose the opposite ends are provided with an elastic end portion 61, preferably having a serpentine shape providing the necessary elasticity for snap-engaging between the slot 62 and the corresponding hook 34A, as later described in detail. Further, the belt 6 is crossed by a plurality of holes 63 apt to be engaged with the corresponding support elements 33A.

Preferably, the belt 6 acts as a locking or keeping means of the first blade 4 on the front surface 31 of the support 3 of the scraping device 2.

In accordance with a variation of the embodiment of the invention, the fastening means comprise a flexible belt 7 made of a strip of an elastic and soft polymeric material. The material can be natural rubber, India rubber, or synthetic rubber based on elastomeric polymers. In particular, the slot 72 formed in the elastic end portion 71 elastically engages with the hook 34B. Similarly, the belt 7 is crossed by holes 73 having dimension and distance one from the other, or distance between centres, reduced with respect to the corresponding support elements 33B arranged on the second surface 32 of the scraping device 2.

With reference to FIGS. 4-8, it is herewith described the assembling of the scraping device 2 in FIG. 1. Firstly, it is describe the locking of the first blade 4 and subsequently that of the second blade 5, even though this is not a binding order.

The locking of the first blade 4 is carried out mounting the first blade 4 on the surface 31 of the support 3. In particular, the holes 42 are engaged in the respective support elements 33A in the traditional way. Preferably, it is a snap engaging as the holes 42 are slightly smaller of the same support elements, such as when said elements have a mushroom-shape.

Figure 5:
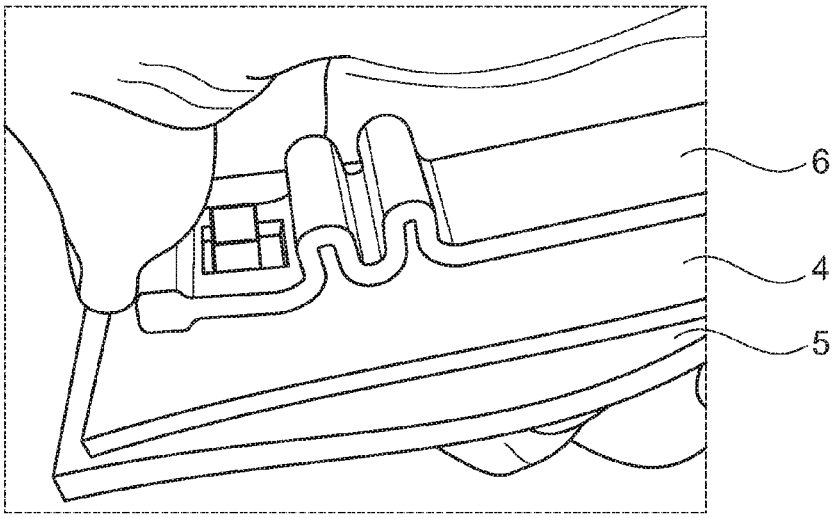
FIG. 5 shows an axonometric view of the particular in FIG. 4 in a second assembling stage.
Figure 6:
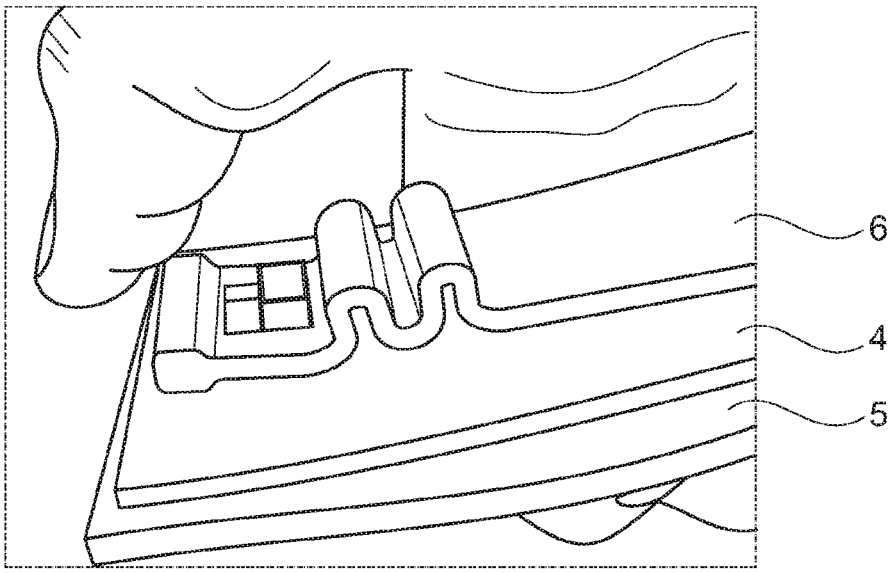
FIG. 6 shows an axonometric view of the particular in FIG. 4 in the final assembling stage.
Figure 7:
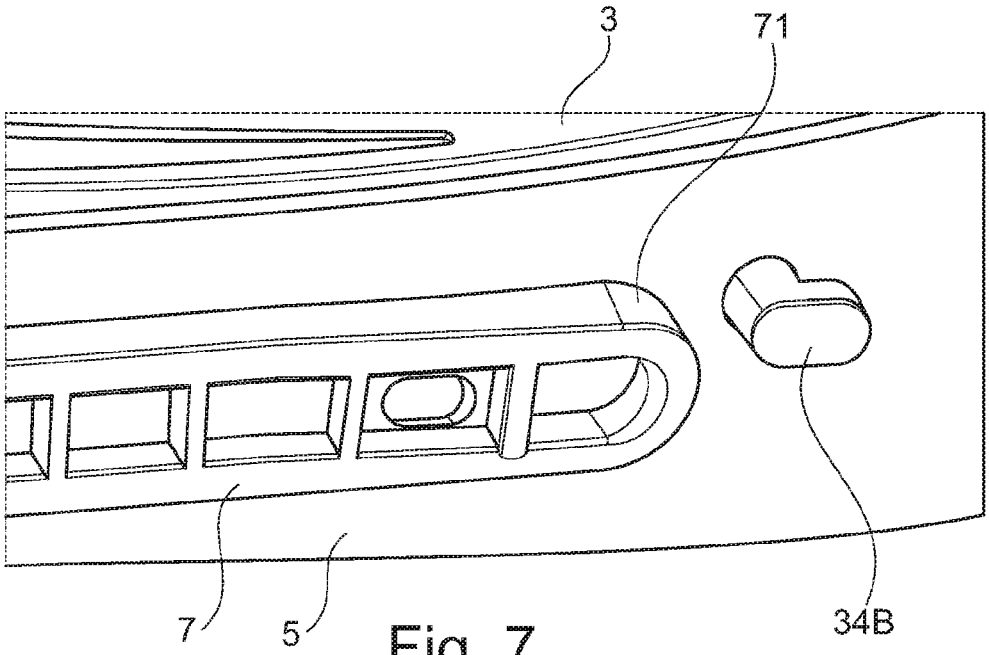
FIG. 7 shows a view of a particular of a first assembling stage of a blade according to a second form of embodiment of the invention.

Then, the first belt 6 is mounted on the first blade 4 engaging first the holes 63 with the same support elements 33A. In this position (FIG. 4), the elastic ends 61 of said belt are placed above the hook 34A, but the respective slot 62 is not aligned with the hook. At this stage, as shown in FIG. 5, the elastic end 61 is compressed thanks to the serpentine portion so as to align the slot 62 with the hook 34A. Now, it is possible to move this end towards the first blade so that the inner edge of the opening of the slot 62 crosses the undercut defined by the hook. Finally, it is sufficient to release the elastic end 61 to make it possible to engage the slot edge with said undercut, as shown in FIG. 6.

The unlocking and the removal of the first blade 4 are done in a simple and quick way carrying out the just described operations but in the reverse order.

Figure 10:
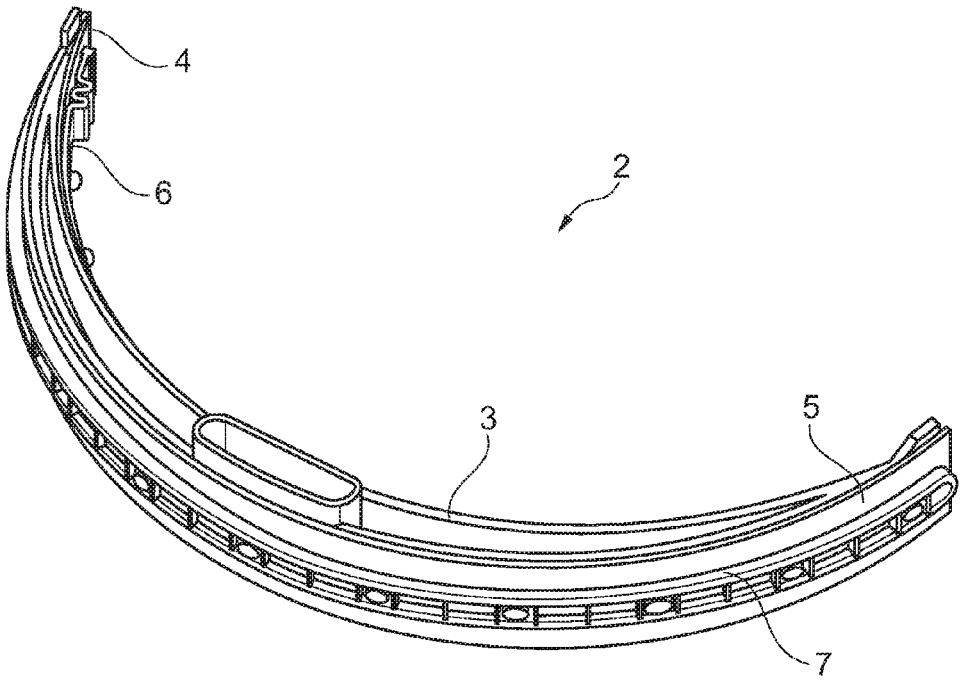
FIG. 10 shows a rear axonometric view of the assembled scraping device in FIG. 2.
Figure 11:
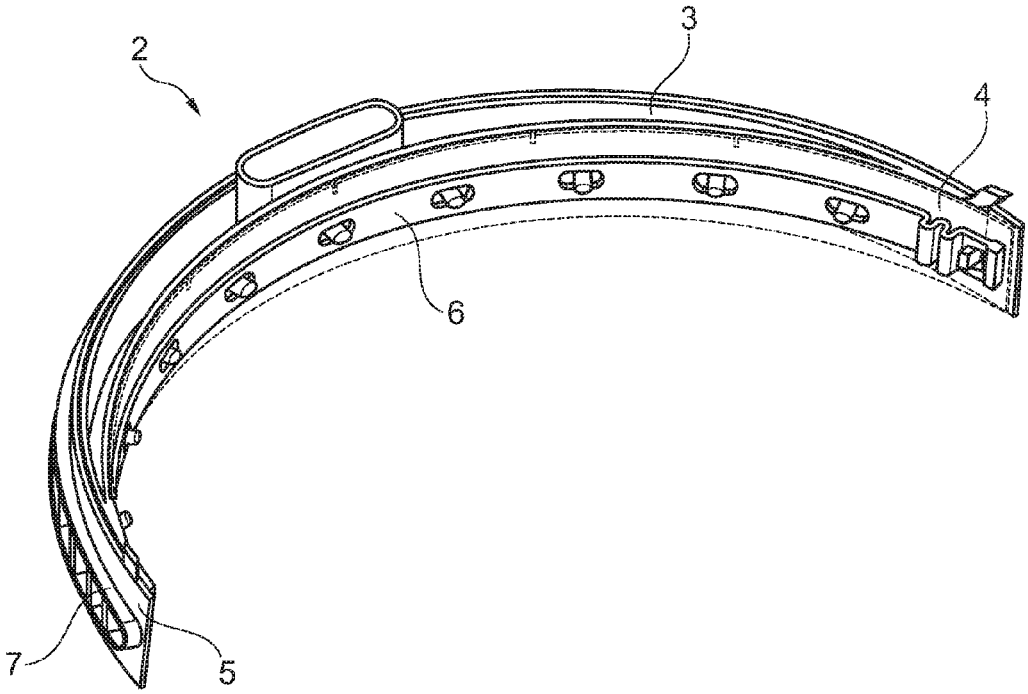
FIG. 11 shows a front axonometric view of the scraping device in FIG. 10.

It is to note that the flexibility together with the elasticity of its ends makes it possible for the first belt 6 to engage the first concave surface 31 of the support 3 of the scraping device 2 compressing the blade 4 in a suitable way. Further, as the scraping device 2 is curved, such longitudinal compression gives a normal push to the belt 6 which winds up onto the blade keeping it actually adherent to the same scraping device. In fact, when belt 6 is mounted, its length between the end hooks 33A is higher with respect to the length of the arch development of the first surface 31 of the same support 3. In this configuration, the belt 6 is compressed against the first blade 4 (FIG. 10).

Figure 8:
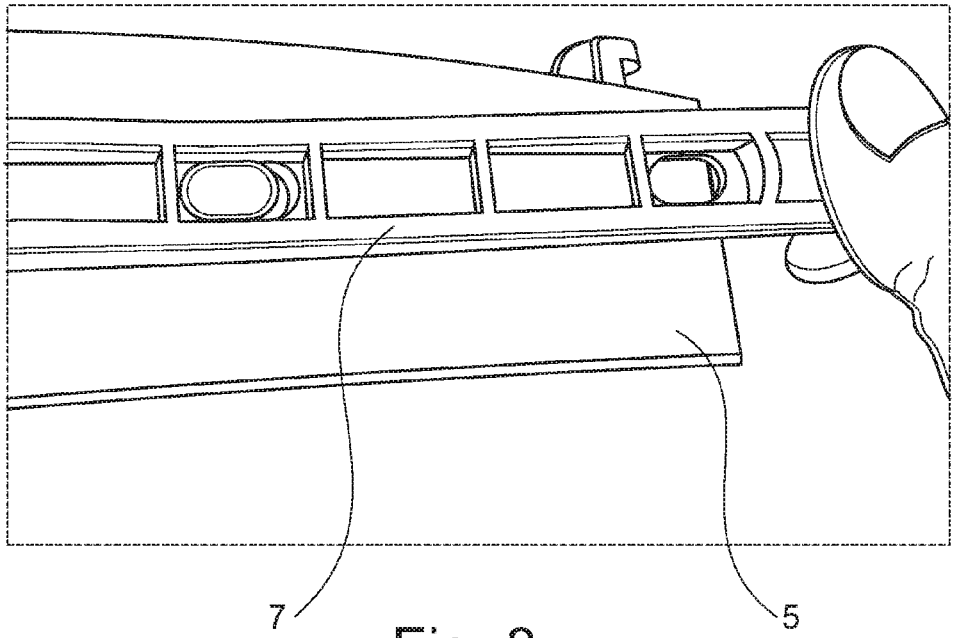
FIG. 8 shows an axonometric view of the particular in FIG. 7 in a second assembling stage.

The locking of the second blade 5 (FIGS. 7-9) is carried out first, mounting the blade 5 on the second surface 32 in exactly the same way as for the mounting of the first blade 4. In fact, the holes 52 are engaged by the support elements 33B projecting from the second surface 32, preferably providing a snap engaging thanks to the mushroom shape of the same elements. Subsequently, as shown in FIG. 8, the second belt 7 is fastened on the second blade 5 engaging the holes 73 with the support elements 33B. Advantageously, as the distances between the holes 73, or the distances between centres of the second belt 7 are reduced with respect to those of the respective support elements 33B, this operation occurs by stretching the same belt thanks to its elastic nature in order to lengthen it enough so as to centre said holes with said support elements 33B. Once the centring has been carried out, in order to obtain the desired engagement, it is enough to push the belt against the support elements and release the belt. Similarly, the undercut of the hook 34B is engaged by the slot 72 pulling the belt and releasing it after the slot has passed said undercut.

It is to note that the elastic traction the belt undergoes in the locking position ensures an adequate compression of the blade along its entire longitudinal extension.

Figure 9:
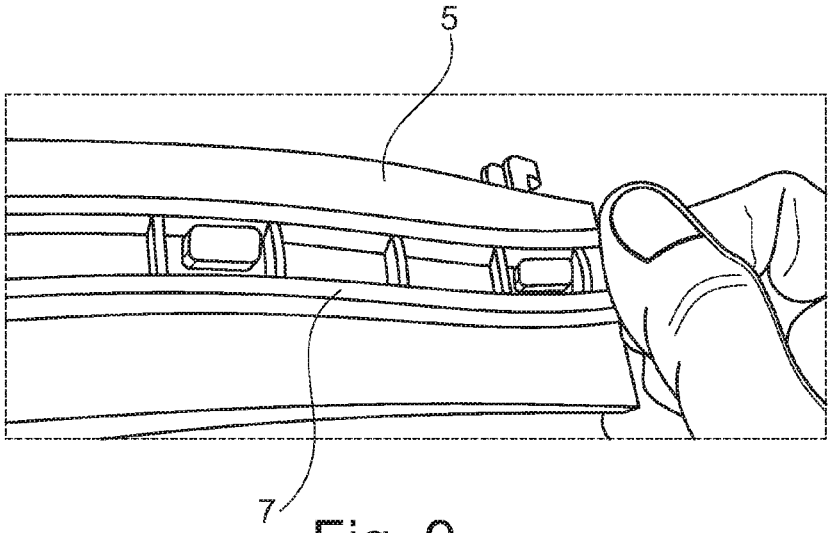
FIG. 9 shows an axonometric view of the particular in FIG. 7 in the final assembling stage.

Advantageously, moreover, the mushroom shape of the support elements 33B further ensure the snap-engaging with belt 7, again in order to ensure the necessary compression of the blade against the support 3 of the scraping device 2. The hook 34B, on each end of the belt 7, in addition ensures an optimal endurance also in case of frontal shocks/bumps that tend to tear the blade in its rear part (FIG. 9).

As previously, the removal is very easy and quick as, thanks to the elasticity of the same belt, it is sufficient to unhook each hole from the locking elements acting in the reverse way with respect to the foregoing.

Preferably, the belt 7 can be provided with a gripping means (not shown), for example tongue shaped projecting from the plane of the same belt and placed in correspondence of the slot 73, so as to facilitate gripping and handling in the assembling and disassembling stages.

From the foregoing, it can be understood that the inconveniences described in the introductory part of the present invention have been overcome.

In particular, the fastening system according to the present invention avoids using hooking elements made of screws or mobile hooks.

It is not necessary for the user to use any tools and to waste a lot of time assembling the scraping device.

Consequently, the fastening system has been simplified reducing, on the one hand, the number of components to handle and on the other, simplifying the operations needed when assembling the scraping device.

Nevertheless, the system reliability has not been hindered at all as the blades are efficiently compressed against the support of the scraping device.

A lot of modifications can be carried out by the skilled in the field without exiting the protection field of the present invention according to the appended claims.

For example, the support elements 33A and 33B of the support 3 and the corresponding holes 63 and 73, respectively of the first 6 and second 7 fastening belt can be replaced by pressure snap fasteners.

The support elements can be formed on the fastening means 6 and 7 so as to engage the corresponding seats on the surfaces 31, 32 of the support 3.

Similarly, the locking hooks 34A and 34B can be formed on the fastening means 6, 7 and the corresponding slots on the surfaces 31 and 32 of the support 3.

The support 3 of the scraping device 2 can be provided with a fastening system of the blades comprising one of the two belts 6 and 7 previously described in order to block the respective blade 4 and 5, while the other blade can be blocked by means of a traditional locking means.

The materials used to make the fastening elements can be traditional hard but flexible plastic materials for the first fastening element 6, such as polyamide polymers, polypropylenes, polyethylene and elastomeric polymers for the second fastening means 7, such as natural rubber, synthetic rubber such as butadiene-styrene, polyurethane, silicone rubber.

The elastic serpentine in correspondence of the ends 61 of the first belt 6 or fastening means can be replaced by a similar elastic means such as a traditional spring suitably fixed to the same belt.

The invention claimed is:

1. A floor washing drying machine comprising:

a scraping device including a curved support on which at least one perforated scraping blade is mounted in a reversible manner by support elements and therein reversibly blocked by fastening means, wherein the fastening means comprises at least a flexible belt including holes to engage with the support elements, and including at least an elastic end portion bearing a slot to engage with a corresponding fastening element formed close to end portions of the support.

2. A floor washing drying machine according to claim 1, wherein the at least one the flexible fastening belt of the at least one blade includes a strip of hard plastic material ending on both sides with the elastic end portion.

3. A floor washing drying machine according to claim 2, wherein the elastic end portion is shaped as an elastically compressible serpentine followed, toward an outer edge, by the slot for snap-engaging with an undercut of the fastening element.

4. A floor washing drying machine according to claim 1, wherein the at least one belt acts as a fastening device to fasten the blade on a first concave surface of the support of the scraping device.

5. A floor washing drying machine according to claim 1, wherein the at least one flexible fastening belt of the blade includes a strip of elastomeric material.

6. A floor washing drying machine according to claim 5, wherein the holes of the at least one belt for engagement with the support elements have a distance between each other shorter than that of the support elements and the slot elastically engages with an undercut of the fastening element.

7. A floor washing drying machine according to claim 5, wherein a terminal section of the belt comprises gripping elements.

8. A floor washing drying machine according to claim 2, wherein the at least one belt acts as a fastening means for the blade on a second convex surface of the support of the scraping device.

9. A floor washing drying machine according to claim 1, wherein the scraping device comprises a first concave surface on which a first blade is mounted for collecting dirt washing liquid, the first blade being fastened by a first belt, and a second convex surface on which a second blade is mounted to dry the dirt washing liquid, the second blade being fastened by a second belt.

10. A floor washing drying machine according to claim 1, wherein the support elements have a mushroom shape.

* * * * *